US005938539A

United States Patent [19]

Hamilton

[11] Patent Number: 5,938,539

[45] Date of Patent: Aug. 17, 1999

[54] GOLF SWING PRACTICE AID AND METHOD

[76] Inventor: David Paul Hamilton, 113 Cowden St., Shannon, Miss. 38868

[21] Appl. No.: 09/104,144

[22] Filed: Jun. 24, 1998

Related U.S. Application Data

[60] Provisional application No. 60/057,880, Sep. 3, 1997.

[51] Int. Cl.[6] ..... A63B 69/36

[52] U.S. Cl. ..... 473/270; 473/273; 473/409

[58] Field of Search ..... 473/257, 272, 473/266, 393, 218, 273, 409, 270, 271

[56] References Cited

U.S. PATENT DOCUMENTS

| | | | |
|---|---|---|---|
| 1,208,995 | 12/1916 | Lyon | 473/272 |
| 3,784,208 | 1/1974 | Weygandt | 473/257 |
| 5,294,125 | 3/1994 | Mietz | 473/257 X |
| 5,529,305 | 6/1996 | Wu | 473/272 |
| 5,707,300 | 1/1998 | May et al. | 473/257 |

*Primary Examiner*—George J. Marlo
*Attorney, Agent, or Firm*—John V. Stewart

[57] ABSTRACT

A triangular guide placed horizontally on the ground between a golfer and a golf ball (11), having a base side (1) parallel to the desired trajectory line (14) for the ball, and left and right sides (4, 5) attached to the base side, converging to a front apex (6) pointing toward the ball. A golfer stands with the thighs, shoulders, and hips aligned with the base of the guide. On the back-swing, the golfer aligns the left forearm with the right side of the guide. On the follow-through, the golfer, aligns the right forearm with the left side of the guide. Labels on the guide remind the golfer of the use of the guide, and of certain aspects of the swing. A ball position indicator (20) may be attached to the practice aid to provide practice in ball placement relative to the golfer.

10 Claims, 5 Drawing Sheets

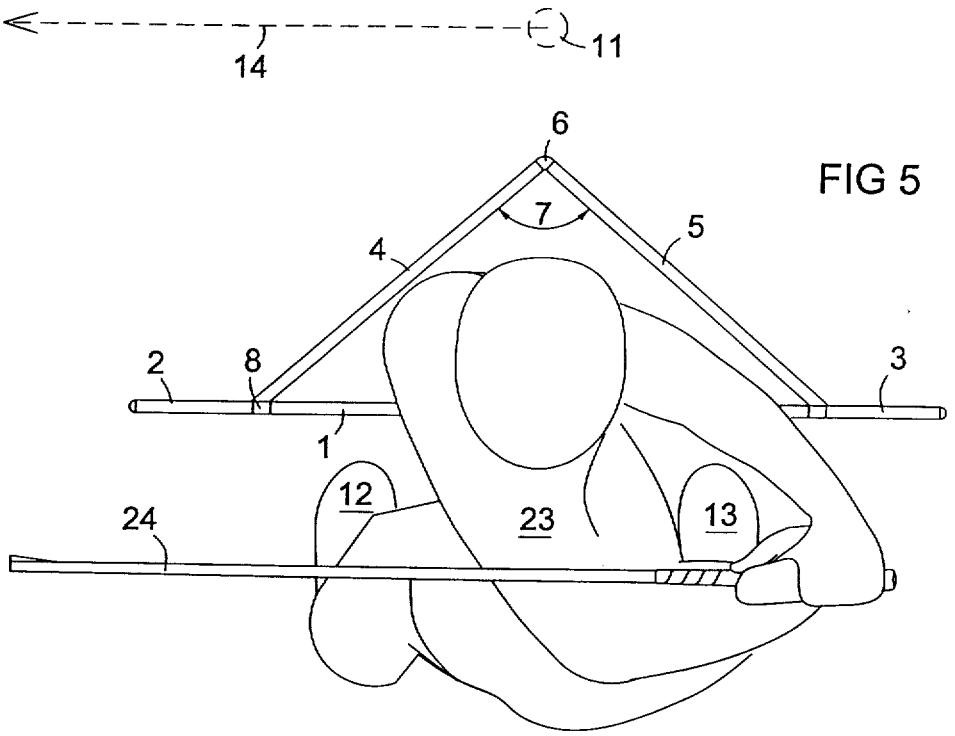
FIG 5
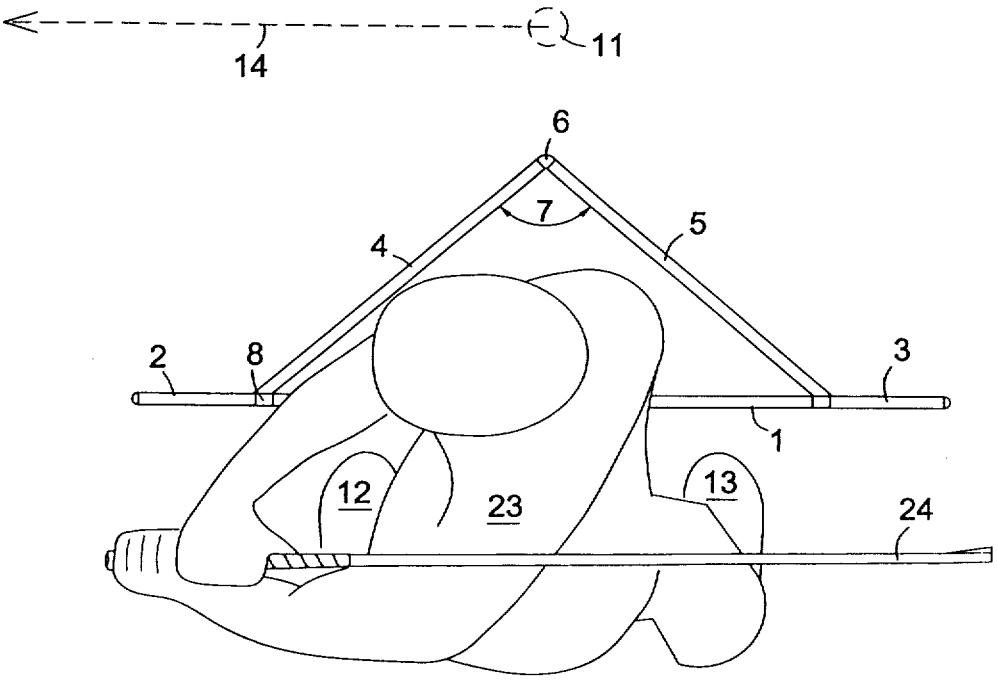

GOLF SWING PRACTICE AID AND METHOD

CROSS-REFERENCE TO RELATED APPLICATIONS

This application claims the benefit of U.S. Provisional Application No. 60/057,880 filed Sep. 03, 1997, with the exception of the ball position indicator described and shown herein, which is new with this application.

BACKGROUND OF THE INVENTION

1. Field of the Invention

This invention is in the field of golf swing practice aids, especially those for practicing squareness of the address stance and proper arm position in the swing.

2. Description of Prior Art

Golf swing practice aids are disclosed in prior patents, but they often lack simplicity or convenience, do not provide optimum guidance, and/or are distracting or unnatural to use.

U.S. Pat. No. 3,415,523 (Boldt) shows a Golfer's Training Device for guiding every aspect of a golfers swing and stance. It includes a helmet for head positioning, a platform for weight shift monitoring, and a golf club guide arm. The present invention allows the golfer to focus on posture and arm position without physical constraints.

SUMMARY OF THE INVENTION

Objectives of the invention are provision of a golf swing practice aid which is simple, compact, light, convenient, safe, inexpensive, and effective at training the address posture and arm angle during the back-swing and follow-through. A further objective is an aid with labels which can be viewed during golf swing practice to remind a golfer of key aspects of the golf swing.

These objectives are achieved by a triangular guide placed horizontally on the ground between a golfer and a golf ball, having a base side (1) parallel to the desired trajectory line (14) for the ball, and left and right sides (4, 5) attached to the base side, converging to a front apex (6) pointing toward the ball. A golfer stands with the thighs, shoulders, and hips aligned with the base of the guide. On the back-swing, the golfer aligns the left forearm with the right side of the guide. On the follow-through, the golfer, aligns the right forearm with the left side of the guide. Labels on the guide remind the golfer of the use of the guide, and of certain aspects of the swing. A ball position indicator (20) may be attached to the practice aid to provide practice in ball placement relative to the golfer.

BRIEF DESCRIPTION OF THE DRAWINGS

FIG. 5 Top view of golfer on back-swing

FIG. 6 Top view of golfer on follow-through

REFERENCE NUMERALS

Figure 1:
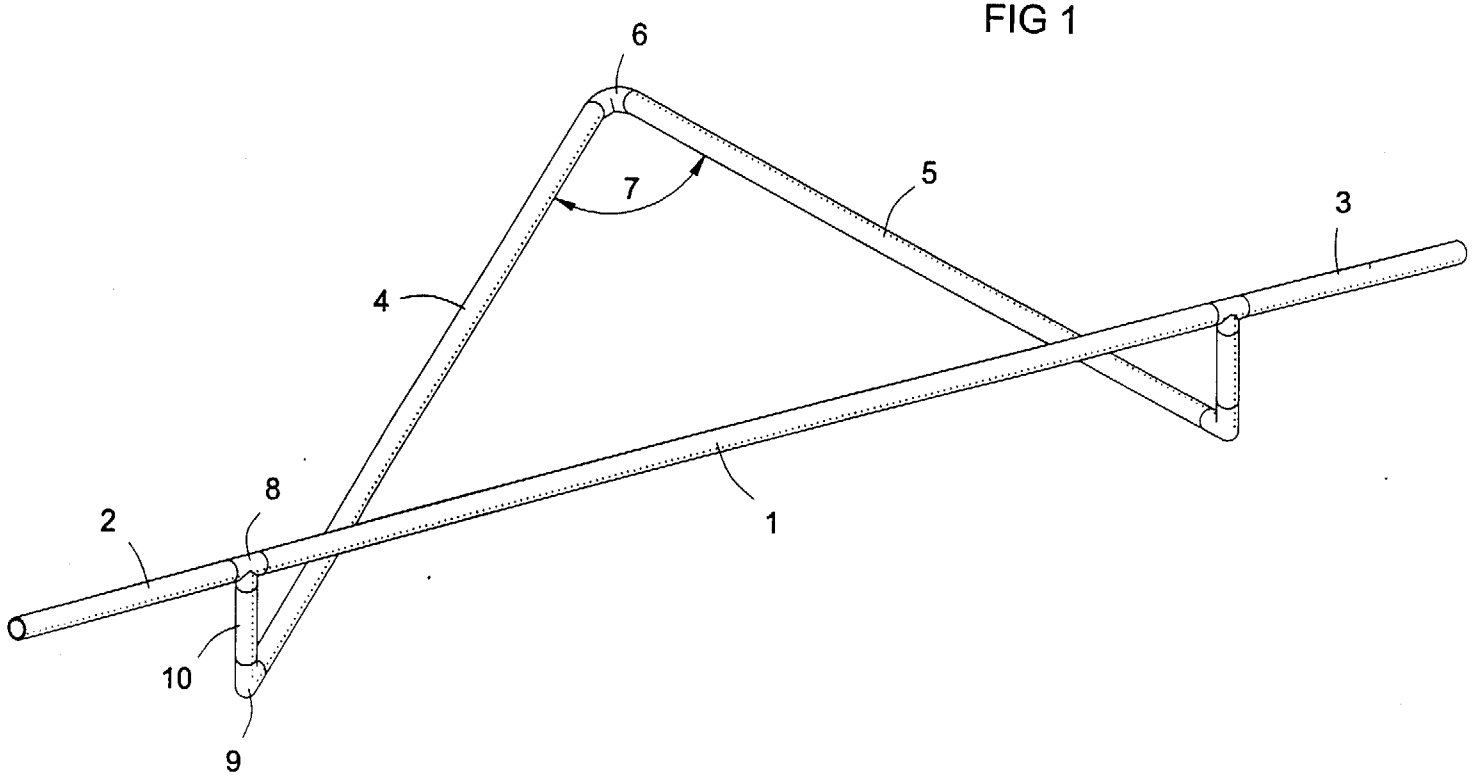
FIG. 1 Perspective view of golf swing practice aid
Figure 2:
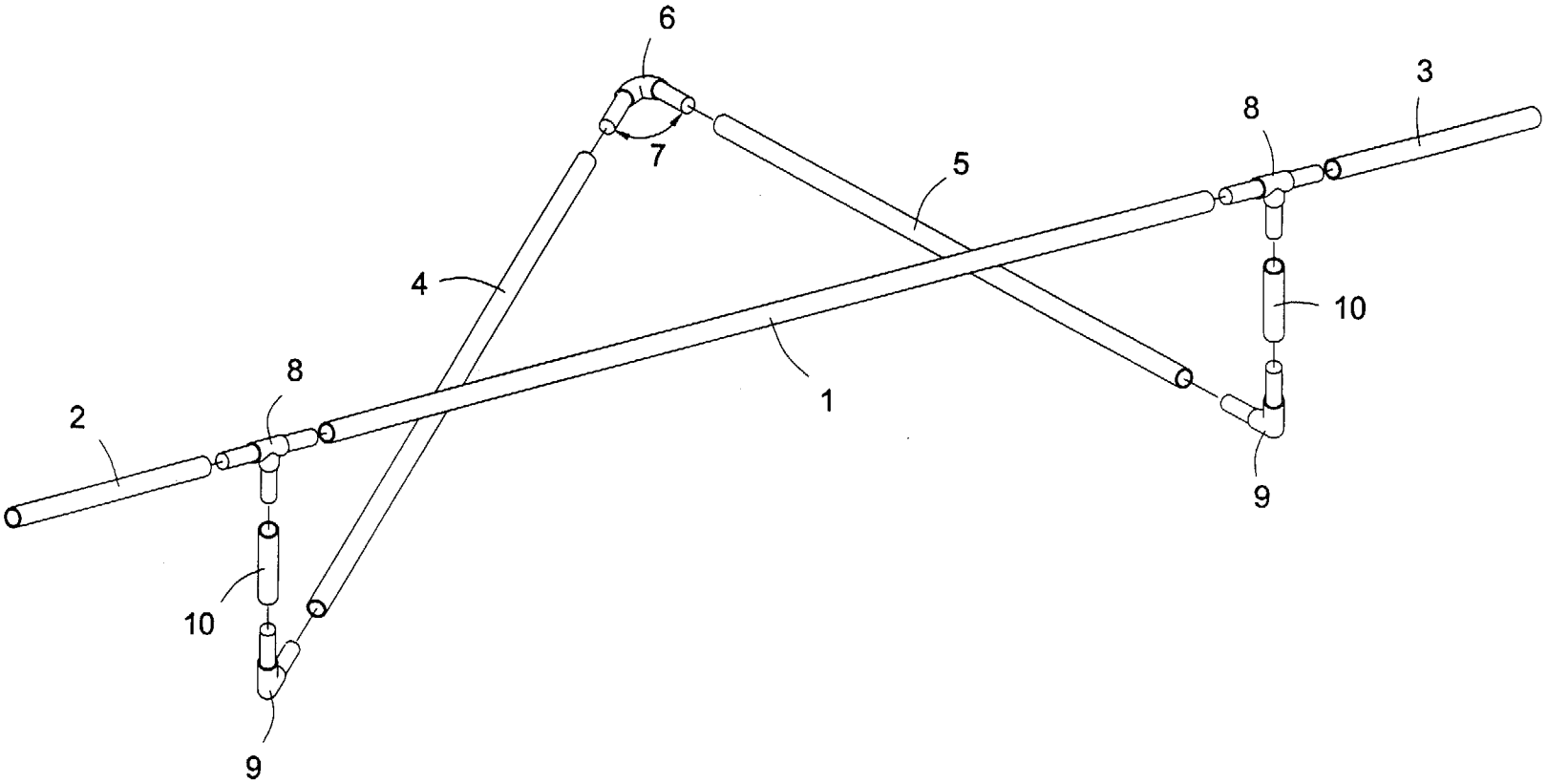
FIG. 2 Exploded view of golf swing practice aid

1. Base side
2. Left base extension
3. Right base extension

4. Left side
5. Right side
6. Front apex elbow
7. Apex angle
8. T-fitting
9. 90-degree elbow
10. Vertical segment
11. Approximate location of golf ball
12. Approximate location of left foot of golfer
13. Approximate location of right foot of golfer
14. Trajectory line of ball flight
15. Left-modified trajectory
16. Leftmost modified trajectory
20. Ball position indicator
21. Pointer on ball position indicator
22. Radial mark on ball position indicator
23. Golfer
24. Golf club

DESCRIPTION

Figure 3:
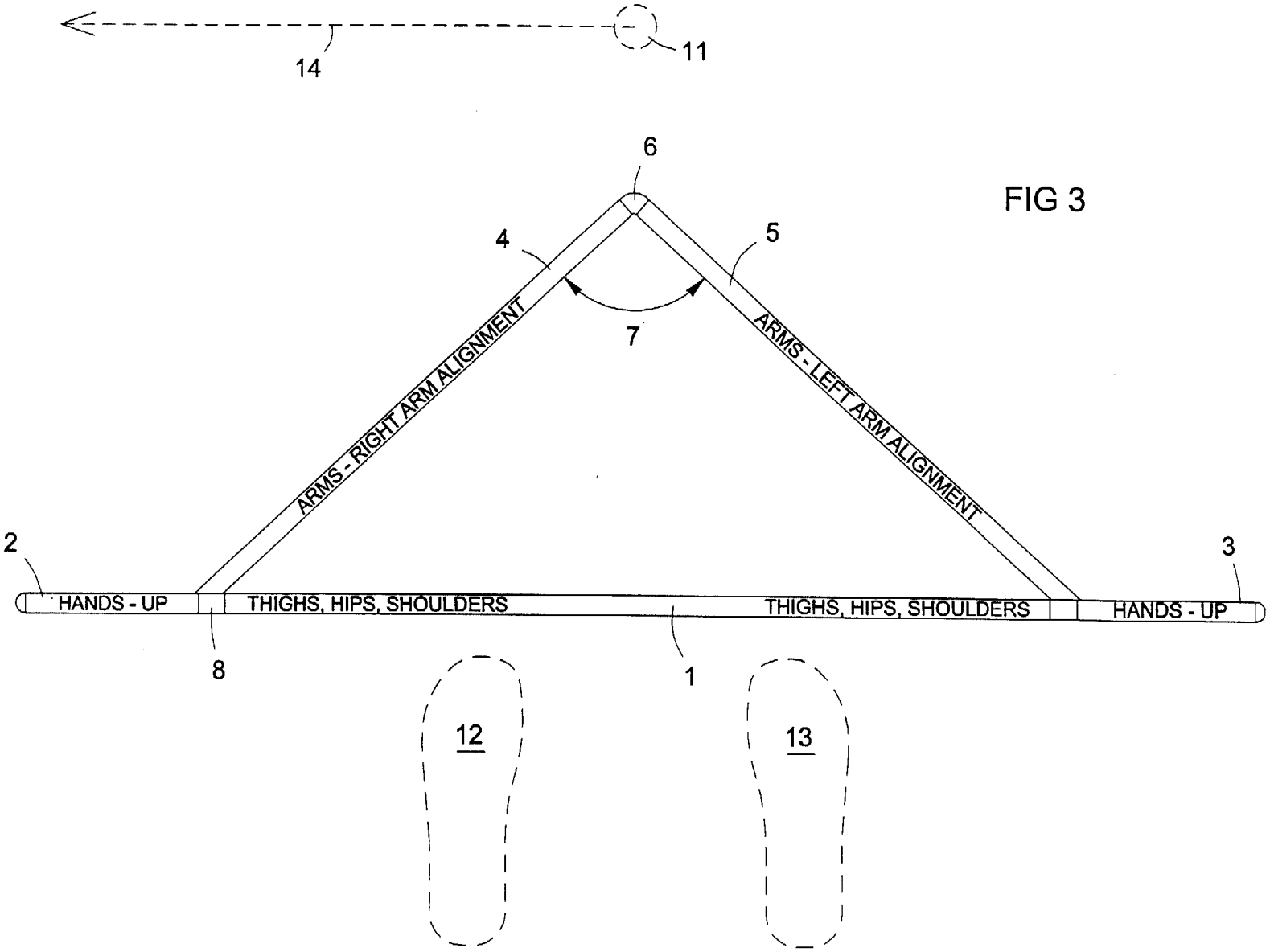
FIG. 3 Top view of golf swing practice aid

The invention is a golf swing alignment guide for training a golfer in the ideal stance and arm motion for powerful, accurate drives. It is placed on the ground between the golfer's feet and the ball, with the apex (6) pointing to the ball. The golfer sees the view of FIG. 3. This allows the golfer to align the hips, thighs, and shoulders with the base (1) of the triangle, producing a square stance in which the plane of the swing intersects the ground along a line (14) through the ball and the target. The sides of the triangle (4 and 5) are oriented to visually guide the motion of the arms.

A right-handed model of the invention is shown and described herein. Golfer's with a left-handed swing will reverse these descriptions from left-to-right. On the back-swing, the arms take the club shaft back (away from the target), upward, and inward (toward the body). At the top of the back-swing, the left forearm should be aligned with the right side of the guide (5), which is preferably labeled "LEFT ARM ALIGNMENT". This forces a full back-swing that naturally turns the hips and shoulders into a cocked position, and starts the arms and club in the plane to be maintained throughout the swing.

On the follow-through after hitting the ball, the arm and body motion should mirror the back-swing, except that the right wrist should preferably remain bent back (away from the target) throughout both the back-swing and follow-through. At the top of the follow-through, the right forearm should be aligned with the left side of the guide (4), which is preferably labeled "RIGHT ARM ALIGNMENT". This forces a full follow-through which is smooth and decelerates on-plane. It causes the hips and shoulders to naturally turn facing the ball trajectory, allowing the golfer to view its flight without disrupting the plane of the swing.

The frame of the invention can be made of a variety of materials. It is preferably made from parts that snap together without glue or additional hardware, for quick assembly by the user. The example shown comprises hollow PVC tubing, and fittings that insert with a manual press-fit into the ends of the tubes. The apex elbow (6) is preferably a 98-degree elbow, but may be in the range of 90–110 degrees. The other fittings are 90-degree elbows (9) and T-joints (8). Alternately (not shown), the frame can be made without the vertical segment (10) or the 90-degree elbows (9). This requires 41/1 39-degree T-joints in place of the 90-degree T-joints (8) shown. The embodiment with vertical segments as shown is preferred, since the base (1) is above the golfer's feet, where it is less likely to be touched accidentally.

Figure 4:
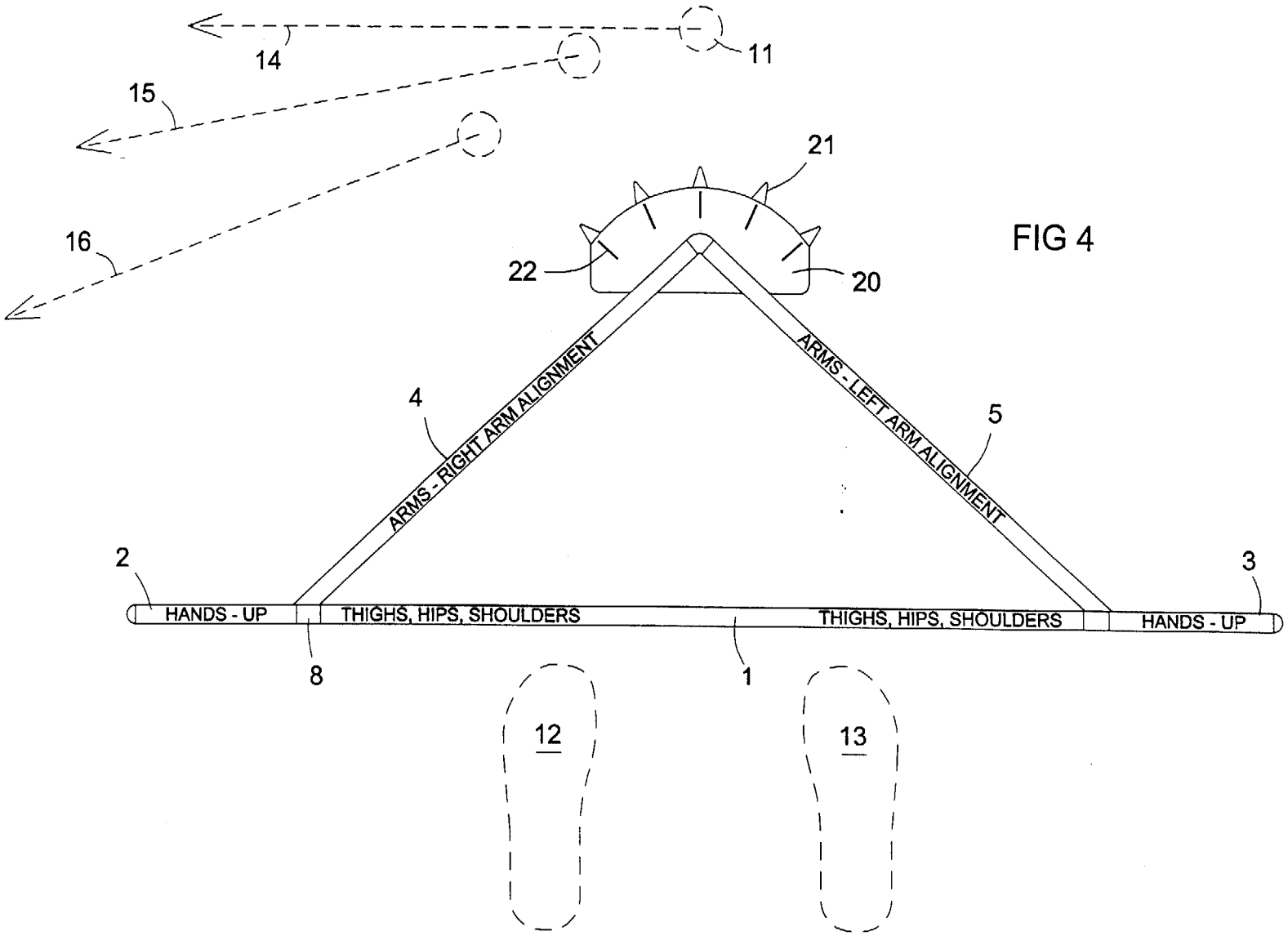
FIG. 4 Top view of golf swing practice aid with ball position indicator

Optionally, a ball position indicator (20) can be attached to the front apex (6) as shown in FIG. 4. It is preferably shaped generally like a protractor, with radiating pointers (21) and/or marks (22) to guide alternative placements of the ball for incremental changes in the trajectory angle, as shown by dashed lines (15) and (16). The marks (22) may be replaced or enhanced by labels adjacent each pointer to indicate the result of ball placement relative to each pointer. The user can practice ball placement by aligning a ball with one or the other of the angle indicators as shown, and viewing the resulting trajectory. The ball position indicator is preferably attached to the apex (6), or to the left and right sides (4, 5) of the frame near the apex, by integral flexible clips, allowing easy attachment and removal of the ball position indicator from the practice aid.

The golf swing practice aid described herein can be used outdoors with normal golf clubs for motion practice without ball contact, or with full contact on a driving range. It can also be used indoors without a club, or with a short, simulated club, preferably with a laser light beam shining from the head-end of the club to trace the plane of the swing along the floor.

Although the present invention has been described herein with respect to preferred embodiments, it will be understood that the foregoing description is intended to be illustrative, not restrictive. Modifications of the present invention will occur to those skilled in the art. All such modifications which fall within the scope of the appended claims are intended to be within the scope and spirit of the present invention.

I claim:

1. A golf swing practice aid comprising:

a generally triangular frame having a base and left and right sides, each side having first and second ends, the first ends of the left and right sides connected to form an apex of the frame, the left side labeled with words denoting right arm alignment;

the right side labeled with words denoting left arm alignment;

left and right vertical segments, each vertical segment having to and bottom ends and a length, the bottom ends of the left and right vertical segments attached to the second ends of the left and right sides respectively, the base connected between the top ends of the vertical segments;

the length of each vertical segment sufficient to hod the base above the height of a golfer's toes; and left and right extension of the base beyond the left and right vertical segments respectively;

whereby a golfer can practice a golf swing by standing with the thighs, shoulders, and hips aligned with the base of the guide, aligning the left arm with the right side of the guide on the back-swng, and aligning the right with the left side of the guide on the follow-through.

2. The golf swing practice aid of claim 1, further comprising a ball position indicator attached to the apex, generally in the form of a protractor with a plurality of radiating pointers.

3. A method for a golfer to practice striking a golf ball on a horizontal surface with a golf club to achieve a desired trajectory line of the ball toward a target, by using a practice aid comprising:

a generally triangular frame having a base and left and right sides, each side having first and second ends;

the first ends of the sides connected together to form an apex of the frame;

the second ends of the sides attached to the base;

the method comprising the steps of;

1) placing the frame horizontally on the horizontal surface between the golfer and the golf ball with the frame apex pointing toward the ball;
2) the golfer aligning his feet, hips, thighs, and shoulders with the base of the frame;
3) the golfer performing a swinging motion with the golf club, including a back-swing portion and a follow-through portion;
4) the golfer aligning his left arm with the right side of the guide on the back-swing;
5) the golfer aligning his right arm with the left side of the frame on the follow-through.

4. The method of claim 3, wherein the practice aid further comprises a ball position indicator attached to the frame apex, generally in the form of a protractor with a plurality of radiating pointers, and the method further comprises the steps of; placing a first ball in line with one of the pointers, striking the first ball according to the method of the previous claim herein, viewing the trajectory of the first ball, placing a second ball in line with another one of the pointers, striking the second ball according to the method of the previous claim herein, and viewing the trajectory of the second ball.

5. A golf swing practice aid comprising:

a generally triangular frame having a left side, a right side, and a base;

the left and right sides each having first and second ends, the first ends of the sides connected to each other to form a front apex of the frame;

the base connected to the second end of the left side to form a left apex of the frame;

the base connected to the second end of the right side to form a right apex of the frame;

the left side labeled with words denoting right arm alignment;

the right side labeled with words denoting left arm alignment;

whereby the practice aid can be placed on the ground between a golfer and a ball to be struck, with the base parallel to a desired ball trajectory line, the front apex extending away from the golfer and pointing toward the ball, such that the right side of the practice aid can be used by the golfer to visually align the left forearm on the back-swing, and the left side of the practice aid can be used by the golfer to visually align the right forearm on the follow-through.

6. The golf swing practice aid of claim 5, further comprising a ball position indicator attached to the front apex, generally in the form of a protractor with a plurality of radiating pointers.

7. The golf swing practice aid of claim 5, wherein the left and right apexes include respective left and right vertical segments that hold the base above the left and right sides, and wherein the base extends to the left of the left apex, and to the right of the right apex.

8. The golf swing practice aid of claim 7, wherein the base is labeled between the left and right apexes with words denoting lateral alignment of the body therewith, and the left and right extensions of the base are labeled with words denoting hands up.

9. The golf swing practice aid of claim 5, wherein the base and sides are plastic tubes, the front apex is formed with an elbow fitting that connects the left and right sides at an angle in the range of 90 to 110 degrees, the left apex includes a left vertical tube connected to the left side by a left 90-degree elbow fitting and connected to the base by a left T-fitting which also holds a leftward extension of the base, and the right apex includes a right vertical tube connected to the right side by a right 90-degree elbow fitting and connected to the base by a right T-fitting which also holds a rightward extension of the base.

10. The golf swing practice aid of claim 9 wherein the front apex is formed with an elbow fitting connecting the left and right sides at an angle 98 degrees.

* * * * *